US005554322A

United States Patent [19]

Kobayashi

[11] Patent Number: 5,554,322

[45] Date of Patent: Sep. 10, 1996

[54] APPARATUS FOR SUPPLYING STARTING-FUEL FOR A CARBURETOR

[75] Inventor: Takeshi Kobayashi, Yokohama, Japan

[73] Assignee: Walbro Japan, Inc., Tokyo, Japan

[21] Appl. No.: 490,071

[22] Filed: Jun. 13, 1995

[30] Foreign Application Priority Data

Jun. 20, 1994 [JP] Japan ..... 6-160543

[51] Int. Cl.[6] ..... F02M 1/04

[52] U.S. Cl. ..... 261/35; 261/39.5; 261/51; 261/71; 261/DIG. 8

[58] Field of Search ..... 261/DIG. 8, 39.5, 261/35, 71, 51

[56] References Cited

U.S. PATENT DOCUMENTS

| | | | |
|---|---|---|---|
| 1,524,865 | 2/1925 | Hughes | 261/DIG. 8 |
| 1,699,324 | 1/1929 | Bracke | 261/DIG. 8 |
| 1,945,199 | 1/1934 | Mock et al. | 261/39.5 |
| 3,576,315 | 4/1971 | Sutton | 261/71 |
| 3,967,610 | 7/1976 | Ross | 261/39.5 |
| 4,229,384 | 10/1980 | Karino et al. | 261/39.5 |
| 4,426,962 | 1/1984 | Otani et al. | 261/39.5 |
| 4,455,266 | 6/1984 | Gerhardy | 261/35 |
| 4,877,560 | 10/1989 | Kenny et al. | 261/39.5 |

FOREIGN PATENT DOCUMENTS

| | | |
|---|---|---|
| 47-26744 | 8/1972 | Japan . |
| 60-204951 | 10/1985 | Japan . |
| 62-55449 | 3/1987 | Japan . |

*Primary Examiner*—Tim R. Miles

*Attorney, Agent, or Firm*—Barnes, Kisselle, Raisch, Choate, Whittemore & Hulbert

[57] ABSTRACT

A carburetor with a main fuel jet and a throttle valve in a mixing passage and an apparatus for automatically supplying an enriched fuel and air mixture when an engine is cranked for starting and initial running of the engine upon starting. The apparatus has a mixing chamber with an air intake passage communicating with the mixing passage upstream of the throttle valve, a fuel inlet passage, and an outlet passage for the fuel and air mixture which communicates with the mixing passage downstream of the throttle valve. A valve for controlling the flow of the enriching fuel and air mixture through the outlet passage is manually movable to its opened position where it is releasably retained by an actuator mechanism operably associated with the throttle shaft for releasing and closing the valve when after the engine starts the throttle valve is initially moved from its idle position toward a full open position of the throttle valve.

11 Claims, 3 Drawing Sheets

APPARATUS FOR SUPPLYING STARTING-FUEL FOR A CARBURETOR

FIELD OF THE INVENTION

The present invention relates to an apparatus for supplying starting-fuel in a diaphragm type carburetor for an internal combustion engine (hereinafter merely referred to as the engine) such as an engine for portable operating machines such as a power saw, a reaper and the like, particularly for a carburetor provided with a bistarter mechanism by which the engine is easily started.

BACKGROUND OF THE INVENTION

In the apparatus for supplying starting-fuel for a film or diaphragm type carburetor provided with a bistarter, as disclosed in Japanese Utility Model Publication No. 47(1972)-26744 and Japanese Patent Application Laid-Open No. 60(1985)-204951, the operation of the bistarter and the operation of starting the engine have to be performed independently and simultaneously, and therefore their operation is cumbersome. Further, the starting fuel supplying apparatus is so large in size that the apparatus is difficult to be employed for a portable operating machine which has a limited space for the engine to be mounted.

SUMMARY OF THE INVENTION

A carburetor with an automatically operable bistarter supplying an enriched fuel and air mixture when an engine is cranked for starting and for initial running of the engine upon starting. The enriching fuel and air are mixed in a chamber and supplied through a control valve to the main carburetor suction or venturi passage downstream of a throttle valve. Preferably, the control valve is opened and energized for operation by movement of a manual starting button which rotates a starting shaft against the bias of a spring to move a valve plunger which is engaged by a cam on the starting shaft to its open position. At the same time, a retaining arm moves into engagement with a starting plate carried by the starting shaft to lock the starting shaft in the operating or open position of the control valve. After the engine has been started when the throttle valve is opened to accelerate the engine, the retaining arm is rotated by a cam on the throttle valve shaft to release the locking of the starting plate which permits the starting shaft to rotate which causes the cam to move the plunger to the closed position of the control valve to stop the flow of the enriching fuel and air mixture into the carburetor intake passage. After the engine is started, preferably, if desired, closing of the control valve to shut off the enriching fuel and air mixture can also be initiated by manually moving the starting button.

This bistarter eliminates the conventional choke valve and system which substantially improves low engine speed operation stability, increases the maximum output of the engine, provides a richer fuel and air starting mixture than a conventional choke valve system and improves the engine starting and warm up properties.

Objects, features and advantages of this invention are to provide a carburetor with a bistarter which is automatically operable, simple in starting operation, extremely compact, improves the safety of portable operating machinery by limiting the speed at which the engine rotates when starting to less than the speed at which a clutch of the machinery automatically engages, supplies to the engine a richer fuel and air mixture than that normally supplied by a conventional choke system, enhances the starting and warm up of an engine, improves the stability of the speed of engine operation, increases the output of the engine, enhances the ability to control exhaust gases, can be utilized with carburetor bodies which were constructed for use of a conventional choke valve and shaft, and is rugged, durable, of relatively simple design, economical manufacture and assembly, and a long useful life in service.

BRIEF DESCRIPTION OF THE DRAWINGS

These and other objects, features and advantages of this invention will be apparent from the following detailed description of the presently preferred embodiment and best mode, appended claims, and accompanying drawings in which:

DETAILED DESCRIPTION

Figure 1:
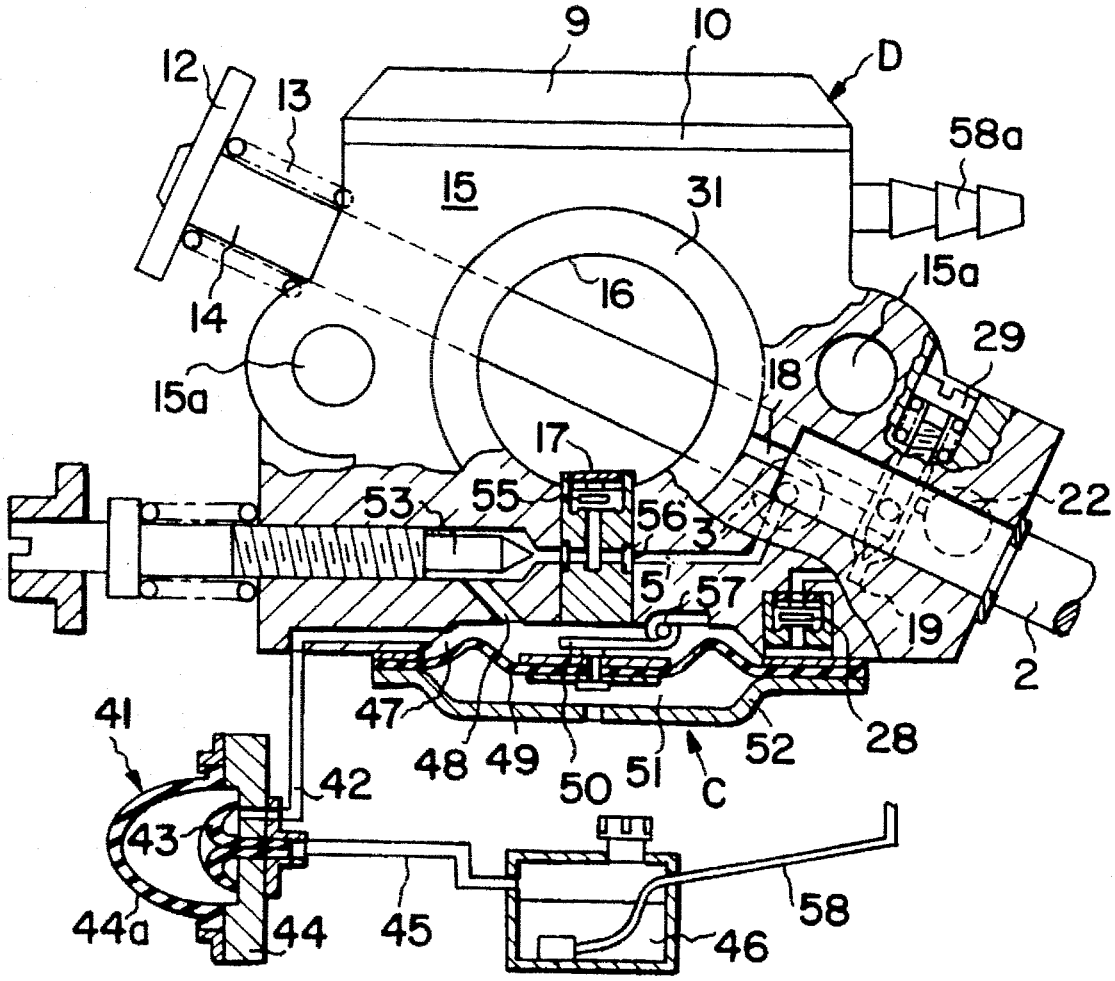
FIG. 1 is an end view partially in section of a carburetor provided with a starting-fuel supplying apparatus according to the present invention.

As shown in FIG. 1, a carburetor with a starting-fuel supplying apparatus according to the present invention, has a carburetor body 15 mounted, along with an air cleaner not shown, on an intake port of an engine by means of bolts which extend through a pair of left and right bolt holes 15*a*. A cover 9 is connected to an upper end wall of the body 15 through a film or diaphragm 10. A chamber for introducing a pulsating pressure of a crankcase chamber of a 2-stroke engine and a pump chamber are defined on the upper and lower sides, respectively, of the diaphragm 10 to constitute a fuel pump D. The fuel pump D sucks fuel from a fuel tank 46 through a pipe 58 and an inlet 58*a* to supply the fuel to a constant pressure fuel metering chamber 47 of a constant pressure fuel supply mechanism C through a flow valve not shown.

In the constant pressure fuel supply mechanism C, a cover 51 is connected to a lower end wall of the body 15 through a film or diaphragm 49, and a constant pressure fuel chamber 47 and an atmospheric chamber 51 are defined on the upper and lower sides, respectively,, of the diaphragm 49. A lever 50 is pivotally supported on the wall of the constant pressure fuel chamber 47 by means of a support shaft 57 with the lever 50 having one end engaged with the diaphragm 49 and the other end engaged with a fuel flow control valve (not shown). Accordingly, when the quantity of fuel in the constant pressure fuel chamber 47 decreases the diaphragm 49 moves upward and opens, the flow valve to supply more fuel to the chamber, and contrarily as the constant pressure fuel chamber 47 becomes filled with fuel the diaphragm moves downward and closes the flow valve to interrupt the supply of fuel. In this way, fuel having a constant pressure is always stored in the constant pressure fuel chamber 47.

Figure 2:
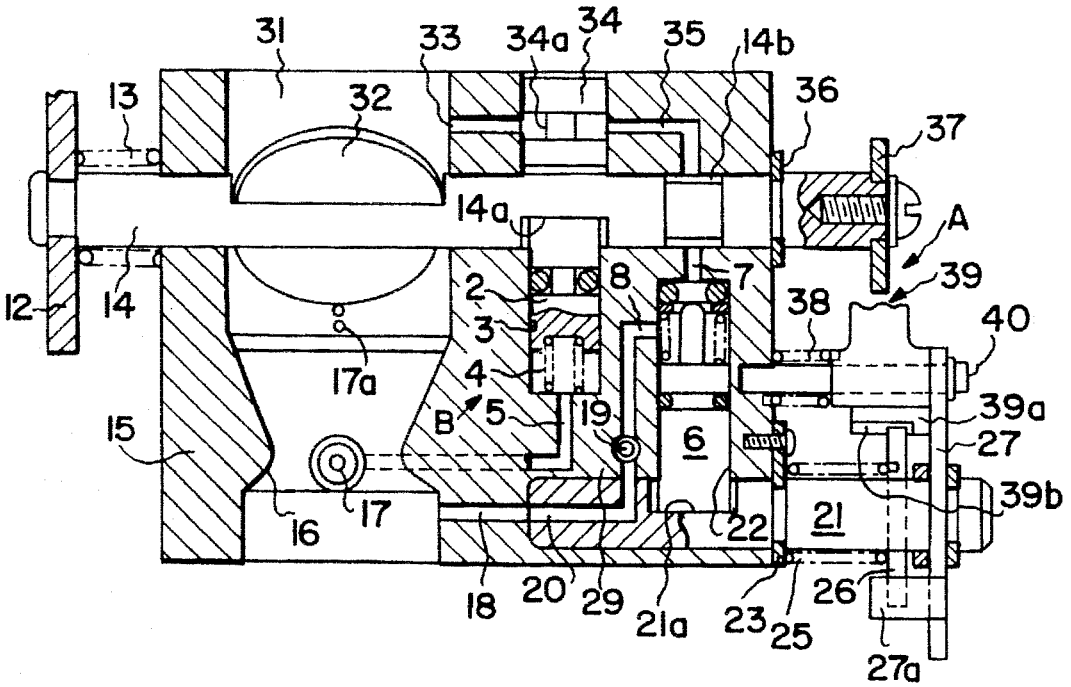
FIG. 2 is a sectional view in plan of the carburetor.

The fuel in the constant pressure fuel chamber 47 is sucked from a high speed fuel jet 17 into an intake passage 31 extending through the body 15 through a passage 48, a high speed fuel regulating needle valve 53 and a check valve 55. As shown in FIG. 2, fuel is likewise sucked from a plurality of low speed fuel jets 17*a* into the intake passage 31. A well known throttle valve 32 is disposed in the intake passage 31 on a throttle valve shaft 14. The low speed fuel jets 17*a* are axially juxtaposed in the vicinity of a closed position (accurately, an idle position) of the throttle valve 32 of the intake passage 31. The high speed fuel jet 17 is disposed in a venturi portion 16 upstream of the throttle valve 32 of the intake passage 31.

Prior to starting the engine, air and fuel vapor in the constant pressure fuel chamber 47 shown in FIG. 1 need to be removed. This is accomplished by a hand-operated suction pump 41 connected between the constant pressure fuel chamber 47 and the fuel tank 46 to supply fuel from the fuel tank 46 through the fuel pump D to the constant pressure fuel chamber 47. In the suction pump 41, a flexible bulb or dome 44*a* is connected to a body 44, and a mushroom composite check valve 43 (an integral combination of an intake valve and a discharge valve) is disposed within the dome 44*a*. When the dome 44*a* is repeatedly pressed and released, air and fuel vapor in the constant pressure fuel chamber 47 pushes open an edge portion of the composite check valve 43 and is sucked through pipe 42 into the dome 44*a*, and then further pushes open a diametrically central part of the composite check valve 43 and is discharged to the fuel tank 46 through a pipe 45. Since the constant pressure fuel chamber 47 will be at a negative pressure, fuel from the fuel tank 46 is sucked into the constant pressure fuel chamber 47 through a pipe 58, an inlet 58*a*, an intake valve and a discharge valve of the fuel pump D and the above-mentioned flow valve associated with the diaphragm 47.

In order to increase the quantity of fuel when the engine is accelerated, a piston type acceleration pump B is disposed within the body 15. As shown in FIG. 2, the acceleration pump B has a piston 2 fitted in a cylinder 3 extending transversely across a bore in which the throttle valve shaft 14 is received. The cylinder 3 has its outer end portion closed by a plug 34 having an annular groove 34*a*. The piston 2 is urged into engagement with a notched cam 14*a* in the through shaft by a spring 4 interposed between the inner end of the cylinder 3 and the piston 2. When the engine is operated at a low speed, fuel in the constant pressure fuel chamber 47 is sucked into the cylinder 3 through the passage 48, the high speed fuel regulating needle valve 53, an annular groove 56 of a fitting portion of the check valve 55 and a passage 5. When the piston 2 is displaced by the notched cam 14*a* by rotation of the throttle valve shaft 24, fuel in the cylinder 3 is supplied to the carburetor intake passage 31 through the passage 5, the check valve 55 and the high speed fuel jet 17.

As shown in FIG. 2, a valve lever 12 is connected to the left end of the throttle valve shaft 14, and the throttle valve 32 is biased to be rotated to its closed position by a spring 13 fastened between the valve lever 12 and the body 15. A stop ring 36 is received on the right end of the throttle valve shaft 14 and axial movement of the throttle valve shaft 14 is prevented by the ring and spring 13. A cam 37 is connected to the right end of the throttle valve shaft 14. The throttle valve shaft 14 is formed with a notched cam 14*a* and an annular groove 14*b* within the body 15.

The bistarter A has a starting-fuel regulating needle valve 29, a starting actuator shaft 21 supported in parallel with the throttle valve shaft 14 within the body 15, and a plunger 6 disposed between the throttle valve shaft 14 and the starting shaft 21. A retainer 23 is received in an annular groove of the starting actuator shaft 21 and secured to the right end wall of the body 15 by a screw so that the starting shaft 21 will not move axially. The body 15 is interiorly formed with a cylinder 22 perpendicular to the starting shaft 21, and a plunger 6 fitted in the cylinder is urged into engagement with a notched cam 21*a* of the starting shaft 21 by the force produced by a spring 63 (FIG. 3).

Figure 3:
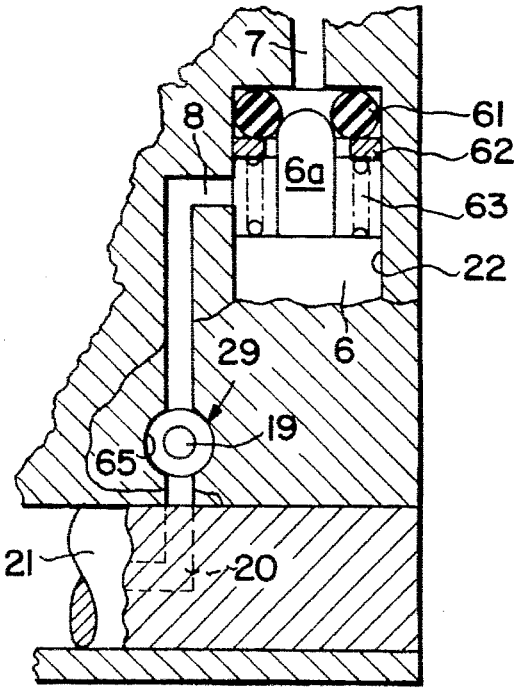
FIG. 3 is an enlarged and fragmentary sectional view in plan showing some of the parts of the carburetor.
Figure 4:
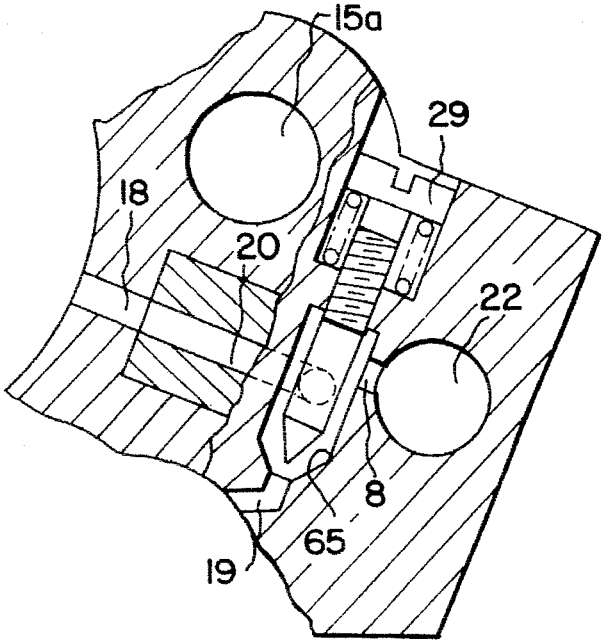
FIG. 4 is an enlarged and fragmentary sectional view showing some of the parts of the carburetor.

As shown in FIG. 3, the spring 63 is interposed between the plunger 6 and a spring seat 62, and the spring seat 62 holds an O-ring 61 at the end of the cylinder 22. The plunger 6 is integrally provided with a valve body 6*a*, and the valve body comes into engagement with the O-ring 61 at an advanced position of the plunger 6 as shown in FIG. 3 to provide a cutoff valve between the passage 8 and the passage 7. The cylinder 22 communicates with a valve chamber 65 of the starting-fuel regulating needle valve 29 through the passage 8. The valve chamber 65 is opened to a portion of the intake passage 31 upstream of the throttle valve 32 through the internal passage 20 of the starting shaft 21 and the passage 18 in the body 15. As shown in FIG. 3, one end of the passage 20 opens to the peripheral surface of the starting shaft 21 and provides a valve which is opened and closed by rotation of the starting shaft 21. The other end of the passage 20 is opened to the end of the starting shaft 21 and the passage 18. The valve chamber 65 of the starting-fuel regulating needle valve 29 crosses between the passage 8 and the passage 20. As shown in FIG. 1, the end on the inlet side of the chamber 65 communicates with the constant pressure fuel chamber 47 through the passage 19 and a check valve 28. The cylinder 22 communicates with the carburetor intake passage 31 (downstream of the throttle valve 32) through the passage 7, annular groove 14*b*, passage 35, annular groove 34*a* and passage 33.

Figure 5:
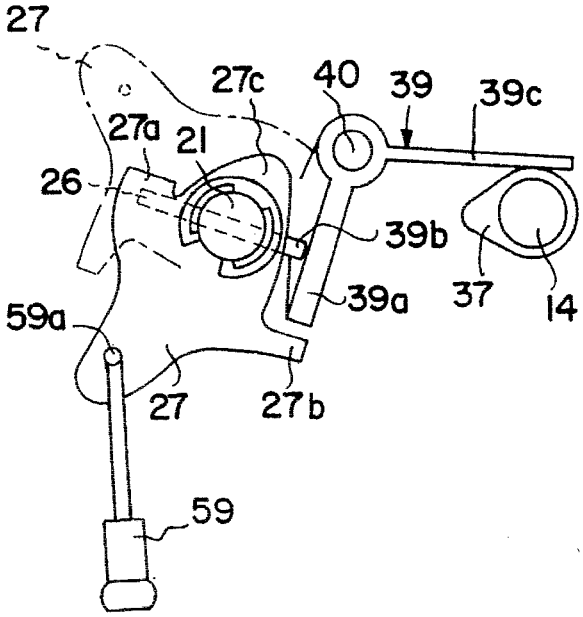
FIG. 5 is a side view showing the actuating mechanism for the starting-fuel supplying apparatus of the carburetor.

As shown in FIGS. 2 & 5, the operating mechanism of the bistarter A has a transverse lever or pin 26 which extends through and is supported on the starting shaft 21, a starting plate 27 rotatably supported on the starting shaft 21, a bell crank 39 rotatably supported by a shaft 40 on the body 15, and a cam 37 connected to the throttle valve shaft 14 for rotation therewith. A torsion spring 25 received on the starting shaft 21 has one end fastened to the body 15 and the other end fastened to the pin 26 to rotate and bias the starting shaft 21 (clockwise in FIG. 5) toward the extended or closed position of the plunger 6 shown in FIG. 3. A torsion spring 38 received on the support shaft 40 has one end fastened to the body 15 and the other end fastened to the bell crank 39 to rotate and bias the bell crank 39 clockwise as viewed in FIG. 5.

As shown in FIG. 5, the starting plate 27 is connected to a starting button 59 by a shaft or wire 59*a* and has a bent tab 27*a* in contact with one end of the pin 26, a stop lever 27*b* in contact with the end of a retaining arm 39*a* of the bell crank 39, and a cam 27*c* engagable with the retaining arm 39*a*. The bell crank 39 has the retaining arm 39*a*, a protrusion 39*b* engagable with the pin 26, and an arm 39*c* in to contact with the cam 37. When the protrusion 39*b* comes in contact with the pin 26, clockwise rotation of the starting plate 27 about the starting shaft 21 is prohibited.

Next, the operation of the starting-fuel supplying apparatus according to the present invention will be described. Prior to starting the engine, the suction pump 41 is operated to remove fuel vapor and air from the constant pressure fuel chamber 47 and supply fuel from the fuel tank 46 to the constant pressure fuel chamber 47. Subsequently, when the starting button 59 is pulled to rotate the starting plate 27 from the position indicated by the chain line in FIG. 5 counterclockwise about the starting shaft 21, the bent tab 27*a* bears on the lever pin 26 so that the starting shaft 21 is rotated counterclockwise against the force of the spring 25. When the cam 27*c* of the starting plate 27 comes in contact with the inclined surface of the retaining arm 39*a* it moves the retaining arm 39*a*, and after the pin 26 gets over the protrusion 39*b*, the stop lever 27*b* bears on the tip of the retaining arm 39*a*.

Now, when the starting button 59 is released, the pin 26 of the starting shaft 21 which is biased to be rotated clockwise by the spring 25 is locked by the protrusion 39*b* and cannot be returned. The bell crank 39 is also biased to be rotated clockwise by the spring 38, and the arm 39*c* comes in contact with the flat portion of the cam 37. In this way, when the starting shaft 21 is rotated through a predetermined angle, the passage 20 is communicated with the valve chamber 65, and the plunger 6 is biased by the force of the spring 63 into the notched cam 21*a* of the starting shaft 21, whereby the valve body 6*a* is moved away from the O-ring 61 to a retracted or open position ( FIG. 2) to provide communication between the passage 8 and the passage 7.

When the engine is cranked for starting, such as by a manual recoil starter, fuel in the constant pressure fuel chamber 47 is sucked into the inlet of the valve chamber 65 through the check valve 28 and the passage 19 due to the negative pressure action of the intake passage 31, and air from the intake passage 31 is sucked into the valve chamber 65 through the passage 18 and the passage 20. A starting mixture of starting fuel and air produced in the valve chamber 65 is sucked into the cylinder 22 through the passage 8 and is further sucked into the intake passage 31 through the passage 7, the annular groove 14*b*, the passage 35, the annular groove 34*a* and the passage 33. With this arrangement, even though the throttle valve 32 is in an idle position, a rich starting mixture of starting fuel and air is supplied downstream of the throttle valve 32 to the intake passage 31 so that the engine is started smoothly.

When the engine starts, fuel in the constant pressure fuel chamber 47 shown in FIG. 1 enters an inlet of the starting-fuel regulating needle valve 29 through the check valve 28 and a passage 19, and at the same time, air from the intake passage 31 enters a valve chamber 65 of the starting-fuel regulating needle valve 29 through a passage 18 and an internal passage 20 of the starting shaft 21. Both the fuel and air are mixed and enter from the valve chamber 65 into the cylinder 22 through a passage 8 and is thence supplied to a portion of the intake passage 31 downstream from the throttle valve 32 through a passage 7 within the body 15 shown in FIG. 2, an annular groove 14*b* of the throttle valve shaft 14, a passage 35, the annular groove 34*a* of the plug 34 and a passage 33.

Even after the engine has been started, the rich starting mixture cointinues to be supplied. When engine warm up is obtained, if the throttle valve shaft 14 is rotated in the acceleration direction (clockwise in FIG. 5) by the valve lever 12, the bell crank 39 is rotated counterclockwise about the support shaft 40 by the cam 37 of the throttle valve shaft 14 to release the locking or latch between the protrusion 39*b* of the retaining arm 39*a* and the pin 26 of the starting shaft 21 so that the starting shaft 21 is rotated clockwise by the force of the spring 25 and stops when the bent tab 27*a* bears on the boss portion of the bell crank 39. As shown in FIG. 3, this interrupts the flow of air through the passage 20 to the valve chamber 65 and advances the plunger 6 by the cam action of the peripheral surface of the starting shaft 21 so that the valve body 6*a* comes into engagement with the O-ring 61 to interrupt the flow between the passage 8 and the passage 7.

Immediately after the start of the engine, if desired, the supply of the starting mixture may be discontinued by manually depressing the starting button 59. When the starting button 59 is depressed, only the starting plate 27 rotates clockwise about the starting shaft 21. The retaining arm 39*a* is moved rightward (counterclockwise in FIG. 5) by the cam 27*c* of the starting plate 27. This releases the locking or latch between the protrusion 39*b* of the retaining arm 39*a* and the pin 26 of the starting shaft 21, so that the starting shaft 21 is rotated clockwise by the force of the spring 25, and the pin 26 of the starting shaft 21 then bears upon the bent tab 27*a* which in turn bears upon the boss portion of the bell crank 39.

From the foregoing description of a carburetor with a bistarter embodying the present invention, it will be apparent that this invention has the following substantial advantages.

Since when the engine starts, the rotational speed of the engine is less than that required for engagement of an automatic clutch, an engaged tool of a portable operating machine is not rotated or driven, which is a safety feature.

Since a starting mixture which is richer than that of a choke system is supplied to the engine, the engine starting properties are excellent and engine warming up operation is easy.

Since no choke valve is provided, intake negative pressure in the vicinity of the fuel jet is stable, the quantity of fuel delivered to the engine during low speed operation is stable and the intake efficiency is high, thus increasing the output of the engine.

Since the starting-fuel supplying apparatus is housed in the carburetor body, the carburetor is small in size, and foreign matter and moisture cannot possibly invade the starting-fuel supplying apparatus.

Since the acceleration pump and the bistarter are housed in the carburetor body, it is possible to fully cope with exhaust gas control.

The bistarter can be operated merely by pulling and releasing the starting button. Further, the operation of the bistarter can be stopped after completion of engine warming up merely by either depressing the starting button or operating the throttle valve. Thus, operation is very simple.

When operation of the bistarter stops, the starting-fuel passage is closed by the starting shaft and plunger valves. Therefore, even in full load operation of the engine, fuel and air do not leak out of the bistarter to the carburetor venturi or suction passage.

Since the starting shaft can be disposed to be operated at substantially the same location and at the same operating angle as that of a conventional choke valve shaft, it can be mounted on a carburetor body having the same specification and construction as that of a choke valve system without changing the construction of the carburetor body.

What is claimed is:

1. A carburetor comprising, a body, a mixing passage through said body having an air inlet and a fuel and air mixture outlet, a throttle valve in said mixing passage between said inlet and said outlet and mounted on a throttle shaft carried by said body, a fuel chamber carried by said body, a main metering jet communicating with said mixing passage upstream of said throttle valve and with said fuel chamber, a mixing chamber carried by said body, a fuel intake passage communicating with said mixing chamber and said fuel chamber, an air intake passage communicating with said mixing chamber and said mixing passage upstream of said throttle valve for supplying air to mix with fuel in said mixing chamber, an outlet passage communicating with said mixing chamber and said mixing passage downstream of said throttle valve for supplying a mixture of fuel and air from said mixing chamber to said mixing passage downstream of said throttle valve, a control valve carried by said body, communicating with said outlet passage, and having a plunger movable to a closed position and an open position of said control valve to control the flow of an air and fuel mixture from the mixing chamber to the mixing passage, an actuator shaft carried by said body and operably connected with said plunger to move said plunger to open and closed positions of said control valve in response to rotary movement of said actuator shaft, and a mechanical mechanism operably associated with said actuator shaft and said throttle shaft for releasably retaining said actuator shaft in the open position of said control valve and releasing and rotating the actuator shaft to the closed position of said control valve in response to rotary movement of the throttle shaft to move the throttle valve from an idle position toward a full open position of said throttle valve.

2. The carburetor defined in claim 1 wherein said plunger cooperates with a cam on the actuator shaft to open and close the control valve in response to rotation of the actuator shaft.

3. The carburetor defined in claim 1 which also comprises a piston accelerating pump carried by said body and operably connected with said throttle shaft.

4. The carburetor as defined in claim 1 which also comprises an adjustable needle valve associated with said fuel intake passage for regulating and adjusting the quantity of fuel supplied to the mixing passage.

5. The carburetor as defined in claim 1 wherein an annular groove is formed in the outer periphery of said throttle valve shaft and said annular groove is disposed in said outlet passage.

6. The carburetor as defined in claim 1 wherein said air intake passage opens through a peripheral surface of said actuator shaft to open said air intake passage to said mixing chamber when said actuator shaft is in the open position of said control valve and closes said air intake passage from communicating with said mixing chamber when said actuator shaft is rotated to move said plunger to the closed position of said control valve.

7. The carburetor as defined in claim 1 wherein the actuator mechanism also comprises a spring yieldably urging the actuator shaft to move said plunger to the closed position of the control valve, a lever carried by the actuator shaft to releasably retain the shaft in the open position of the control valve, and a retaining arm releasably engagable with the lever to retain the shaft against the bias of the spring in the open position of the control valve.

8. The carburetor of claim 7 which also comprises a plate rotatably carried by the actuator shaft, and a manually movable button operably connected with said plate for manually rotating said plate against the bias of said spring to move the actuator shaft to the open position of the control valve.

9. The carburetor of claim 7 wherein the actuator mechanism also comprises a cam carried by said throttle shaft for rotation in unison therewith and a follower associated with said cam and operably connected with said retaining arm for disengaging said retaining arm from said lever in response to rotation of said throttle shaft to move said throttle valve from an idle position towards a fully open position of said throttle valve.

10. The carburetor of claim 8 wherein the actuator mechanism also comprises a stop carried by said plate and engagable with said retaining arm to limit rotation of said actuator shaft toward the open position of the control valve.

11. The carburetor of claim 8 wherein the actuator mechanism also comprises a tab carried by said plate and engagable with said lever to rotate said actuator shaft in unison with rotation of said plate to move the actuator shaft toward the open position of the control valve.

* * * * *